United States Patent [19]

Davis et al.

[11] Patent Number: 4,902,242

[45] Date of Patent: Feb. 20, 1990

[54] PANEL MOUNT, CABLE TERMINABLE CONNECTOR WITH DIE CAST HOUSING AND DRAWN SHELL

[75] Inventors: Wayne S. Davis, Harrisburg; Robert N. Whiteman, Jr., Middletown, both of Pa.

[73] Assignee: AMP Incorporated, Harrisburg, Pa.

[21] Appl. No.: 359,233

[22] Filed: May 31, 1989

[51] Int. Cl.[4] ..... H01R 13/648

[52] U.S. Cl. ..... 439/404; 439/607

[58] Field of Search ..... 439/108, 607–610, 439/404, 405

[56] References Cited

U.S. PATENT DOCUMENTS

| | | | |
|---|---|---|---|
| 4,431,249 | 2/1984 | Frantz et al. | 439/404 |
| 4,693,533 | 9/1987 | Szczesny et al. | 439/404 |
| 4,701,139 | 10/1987 | Good et al. | 439/460 |
| 4,808,125 | 2/1989 | Waters et al. | 439/607 |
| 4,822,303 | 4/1989 | Nakamura et al. | 439/607 |

*Primary Examiner*—Gary F. Paumen

*Attorney, Agent, or Firm*—David L. Smith

[57] ABSTRACT

An electrical connector (20,20') for terminating to conductors of a cable (24,24') and for mounting through an aperture (150) in a panel (152) has an electrically conductive die cast housing (26) having an aperture (52) therein. The connector (20,20') is adapted to be mounted to the panel (152) proximate the aperture (150) in the panel. A drawn shell (28) having an aperture therein is received in the die cast housing aperture (52) such that the drawn shell (28) and die cast housing (26) are electrically commoned. The drawn shell (28) is adapted to extend through the aperture (150) in the panel (152). An insulative insert having terminals (32) secured therein is received and secured in the drawn shell aperture. The terminals (32) have a cable conductor engaging portion (94,170) adapted to be terminated to respective conductors of the cable (24,24'). The shell (28) provides shielding for the terminals (32) with a die cast housing (26) electrically commoned with the shell (28) providing an electrical path to a ground on the panel (152).

8 Claims, 9 Drawing Sheets

54
71
70
72
73
54
56
62
26
46
60
42
62
50
48
44
156
58
64
40
28
46
68
66
67
30
124
36
122
29
132
31
114
134
130
128
94
22
96
124
32
22
116
126
34
120
136
128
126
134
24

PANEL MOUNT, CABLE TERMINABLE CONNECTOR WITH DIE CAST HOUSING AND DRAWN SHELL

BACKGROUND OF THE INVENTION

This invention relates to a panel mount electrical connector, and in particular, to a shielded panel mount electrical connector adapted to terminate to conductors of a cable wherein the electrical connector has a cast housing and a drawn shell electrically commoned therewith to provide shielding and a path to ground on the panel as well as a plastic insert in which terminals are secured. Typically, the connector has one or more terminating covers to facilitate terminating conductors of the cable to the terminals.

There is disclosed in US-A-4,808,125 an electrical connector for mounting on a printed circuit board. The connector has an electrically conductive die cast housing having an aperture therein. A drawn shell having an aperture therein is received in the die cast housing aperture such that the drawn shell and die cast housing are electrically commoned. A plastic insert having terminals secured therein is received and secured in the drawn shell aperture. The terminals have a mounting portion extending beyond the plastic insert that is adapted to interconnect with traces on the printed circuit board on which the connector is mounted. The shell provides shielding for the terminals with the die cast housing electrically commoned with the shell providing an electrical path to ground on the printed circuit board.

SUMMARY OF THE INVENTION

In accordance with the present invention, an electrical connector for terminating to conductors of a cable and for mounting through an aperture in a panel has an electrically conductive die cast housing having an aperture therein. The connector is adapted to be mounted to the panel proximate the aperture in the panel. A drawn shell having an aperture therein is received in the die cast housing aperture such that the drawn shell and die cast housing are electrically commoned. The drawn shell is adapted to extend through the aperture in the panel. An insulative insert having terminals secured therein is received and secured in the drawn shell aperture. The terminals have a cable conductor engaging portion adapted to be terminated to respective conductors of the cable. The shell provides shielding for the terminals with a die cast housing electrically commoned with the shell providing an electrical path to a ground on the panel.

DESCRIPTION OF THE PREFERRED EMBODIMENT

Figure 1:
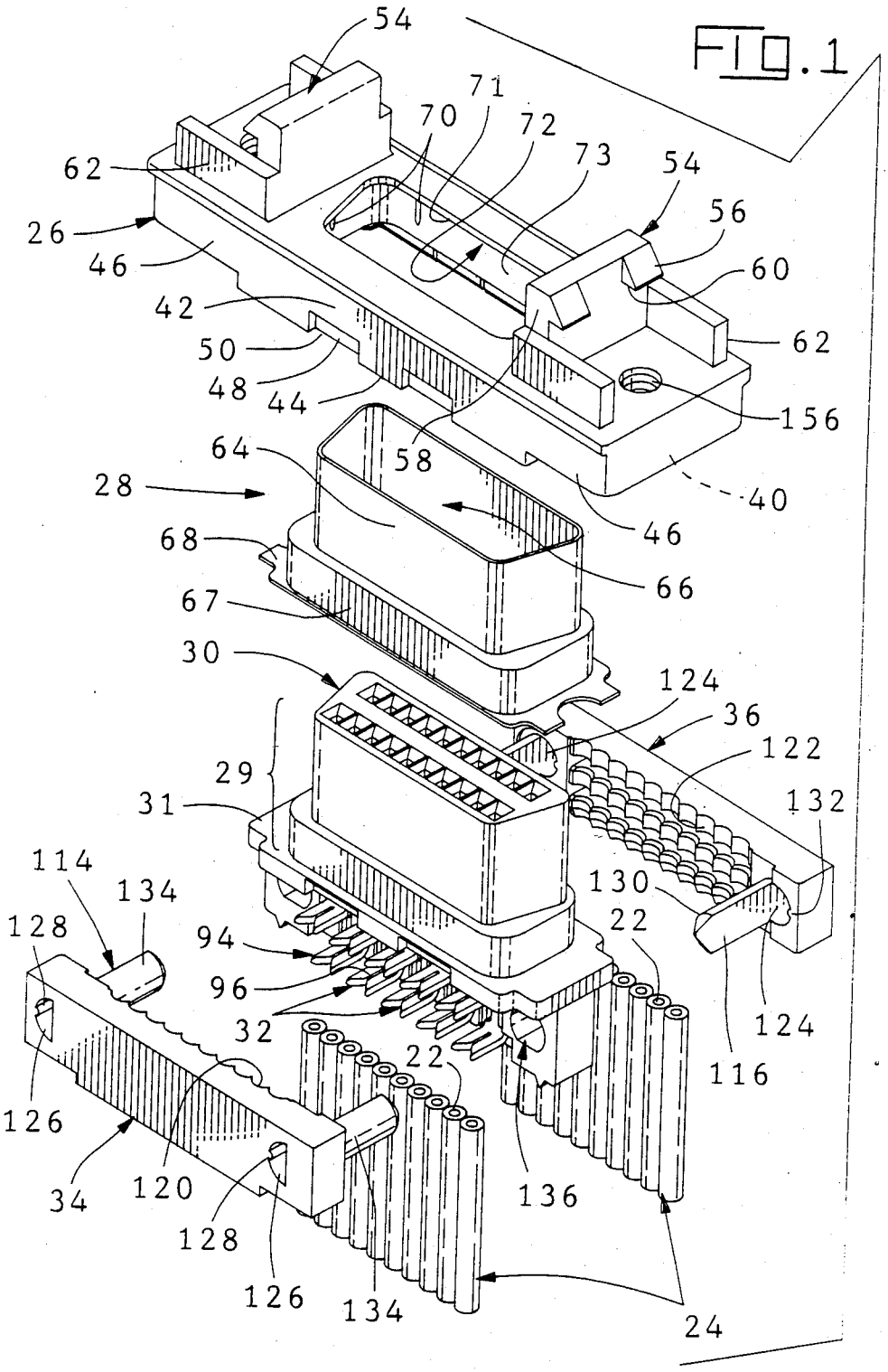
FIG. 1 is an exploded perspective view of an electrical connector in accordance with the present invention.

An exploded perspective view of a shielded panel mount connector 20 for terminating to conductors 22 of a cable 24, in accordance with the present invention, is shown in FIG. 1. Connector 20 is comprised of die cast housing 26, drawn shell 28, insert 30 having terminals 32 secured therein, and terminating covers 34,36.

Die cast housing 26 may be fabricated of any known, electrically conductive material then plated such as with tin; a magnesium alloy, aluminum alloy or zinc alloy is preferred. Die cast housing 26 is elongate having upper surface 38, lower surface 40, side walls 42 with respective lower edges 44, and flanges 46 at opposite ends thereof. Side walls 42 extend beyond lower surface 40 and have tabs 48 formed therein by spaced slots 50. Aperture 52 extends through die cast housing 26 from upper surface 38 to lower surface 40 and is profiled to receive drawn shell 28. Latching members 54 extend from upper surface 38 for securing a mated complementary connector (not shown) to connector 20. Upon mating with a complementary connector, latch means on the complementary connector, engage and pass over tapered surface 56 of latch ear 58 thence snap under and engage latching shoulder 60. Housing 26 may also have other features such as rails 62.

Drawn shell 28 is electrically conductive, typically fabricated of steel and bright tin over copper plating. The shroud 64 of shell 28 has a similar outer profile to aperture 52 and is received therein such that drawn shell 28 and die cast housing 26 are electrically commoned. In a preferred embodiment, shroud 64 is received in aperture 52 in an interference fit to assure electrical conductivity between die cast housing 26 and drawn shell 28. In a further preferred embodiment, the profile of shroud 68 is a subminiature D or trapezoidal shape which provides polarization of connector 20 during mating with a complementary connector. Shroud 64 extends forwardly of a transition portion 67 and a substantially rectangular flange 68, and is shaped to be received in aperture 52 as well as receive insert 30 in aperture 66. Transition portion 67 in cross-section, parallel to upper surface 38, is substantially rectangular in shape having rounded corners. Transition portion 67 is received in complementary recess 69 in lower surface 40. Upon insertion of drawn shell 28 into aperture 52 from lower surface 40, shroud 64 passes partially through aperture 52, transition portion 67 is received in recess 69 in mechanical and electrical engagement, and flange 68 is received between side walls 42. Transition portion 67 engages recess 69 and flange 68 engages lower surface 40 around the periphery of aperture 52 making mechanical and electrical contact therewith, which provides means for making electrical continuity between shell 28 and housing 26, and prevents shell 28 from passing through aperture 52. Seating flange 68 against lower surface 40 assures that shroud 64 protrudes beyond upper surface 38 a predetermined distance.

Figure 2:
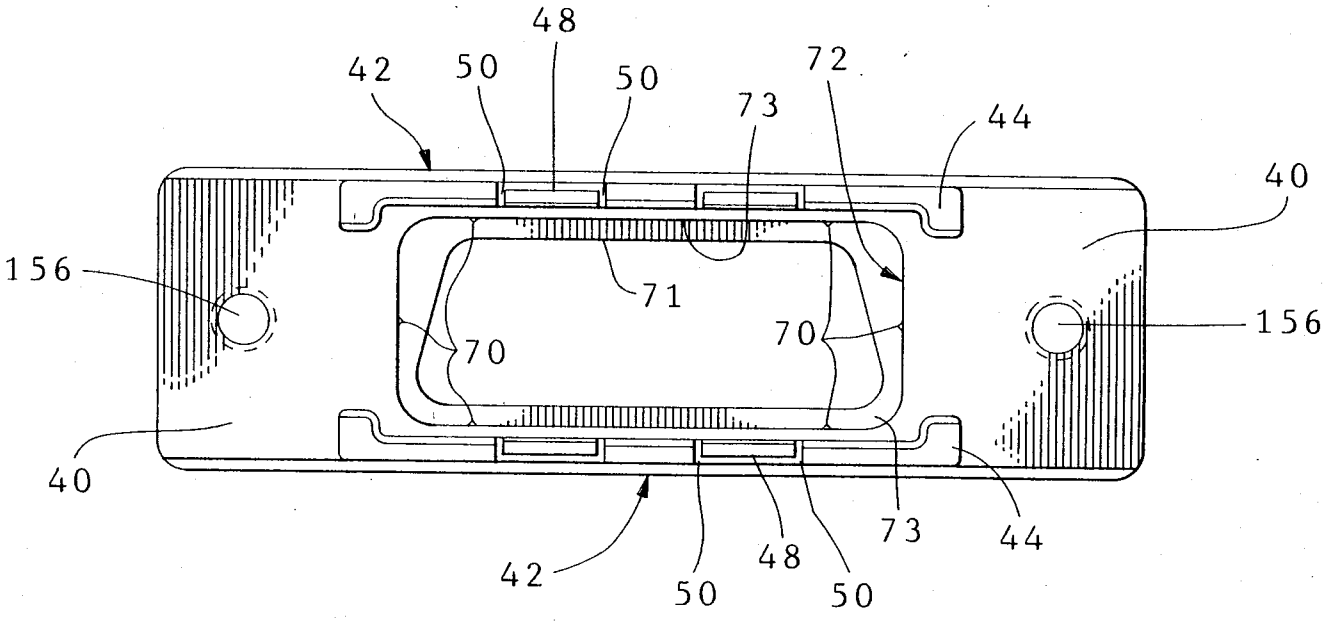
FIG. 2 is a rear view of the die cast housing shown in FIG. 1.

Barbs 70 extend inwardly of inner wall 72, as best seen in FIG. 2, to engage shell 28 upon insertion thereof into aperture 52 to assure shell 28 is received in aperture 52 of housing 26 in an interference fit. Inner wall 72 is comprised of two regions, first region 71 defining recess 69 and second region 73 received proximate the base of shroud 64. In a preferred embodiment, barbs 70 are on second region 73 and engage transition portion 67 of shell 28. Barbs 70 provide further mechanical engagement between shell 28 and housing 26 to further assure electrical continuity therebetween and thus also provide means for providing electrical continuity between shell 28 and housing 26. Barbs 70 may be strategically located on inner wall 72 to center shell 28 in aperture 52 upon insertion. Barbs 70 are shown both along sidewalls 42 and adjacent flanges 46. Barbs 70 are shown engaging shell 28 along sidewalls 42 in FIG. 3. Alternatively, protrusions or barb means on drawn shell 28 extending outwardly to engage housing 26 upon insertion of shell 28 into aperture 52 could provide electrical continuity between housing 26 and shell 28.

Figure 3:
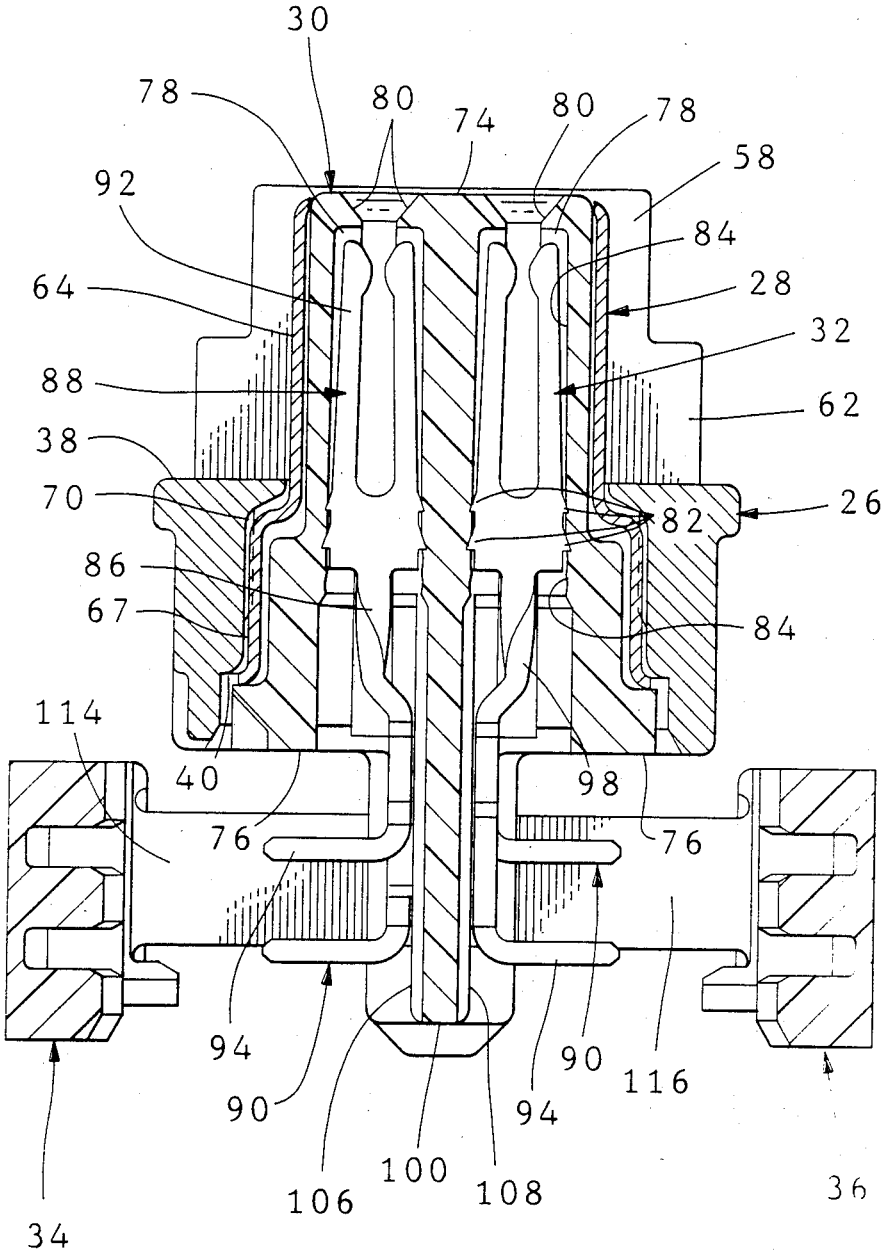
FIG. 3 is a side sectional view of a connector.

Insulative insert 30 is manufactured of a dielectric material, typically a plastic. Insert 30 is adapted to be received in aperture 66 of drawn shell 28, with a forward portion 29 of insert 30 having a similar outer profile to the inner surface of aperture 66 in shell 28. Insert 30 further includes a flange 31 and a mating portion. Insert 30, as best seen in FIG. 1 and in cross-section in FIG. 3, has mating face 74, opposing rear face 76 and a plurality of terminal receiving passages 78 extending therebetween. Terminal receiving passages 78 are arranged in two rows, having tapered lead in surfaces 80 in mating face 74 to facilitate mating, and have terminals 32 secured therein. Terminals 32, which are inserted from rear face 76, are secured in passages 78 such as by barbs 82 that plow through the plastic forming walls 84 with the plastic flowing around the barbs 82 to secure terminals 32 by engaging walls 84 in an interference fit. Barbs 82 are located on a central body portion 86 of terminals 32 between mating portion 88 and a cable conductor terminating portion 90. Mating portion 88, shown in the preferred embodiment as receptacle 92, extends from a first side of body portion 86 toward mating face 74 in passage 78 where walls 84 provide an anti-overstress function. Terminating portion 90 extends from another side of body portion 86 toward and beyond rear face 76, and has on its free end a slotted insulation displacing plate 94. Plate 94 extends substantially normal to the axis of terminals 32 and has an insulation displacement slot 96 also extending normal to the axis of terminals 32. Adjacent terminals 32 have terminating portions 90 of alternate lengths so that the insulation displacing plates 94 of one row of terminals form two rows, as best seen in FIGS. 1 and 3. Twist 98 in central body portion 86 provides the planar orientation of receptacle 92 to be parallel to slots 96.

Terminal support block 100 extends rearward from rear face 76 between the two rows of contact receiving passages 78. Insulation displacement plates 94 extend outwardly from outer surface 106,108 of block 100. During termination of conductors 22 in slots 96 of plate 94, plates 94 bear on respective surfaces 106,108 of block 100.

Terminal support block 100 includes apertures 110,112 which form spaced apertures, at opposite ends thereof.

Cable terminable connector 20 may terminate conductors 22 of either a ribbon cable or a round cable; FIG. 1 shows two short segments of cable 24 for terminating to connector 20 which may represent either a ribbon or round cable. Conductors 22 of cable 24 may be terminated to the cable conductor terminating portions 90 of respective terminals 32 using any known termination technique and structure. Thus, terminating covers 34,36 provide means for terminating conductors of a cable to the cable conductor terminating portion of the terminals. A preferred termination technique and structure are taught by U.S. Pat. No. 4,808,125, the disclosure of which is hereby incorporated by reference.

Cable 24 is terminated by first preassembling terminating covers 34,36 to insert 30. Complementary shaped, spaced leg means 114 on terminating cover 34 and leg means 116 on terminating cover 36 are axially aligned with apertures 110,112 from opposite sides of terminal support block 100. Terminating covers 34,36 are moved toward terminal support block 100, with leg means 114,116 engaging the walls 118 of apertures 110,112 in an interference fit at a pretermination position to secure terminating covers 34,36 to insert 30. In the pretermination position, shown in FIG. 3, fluted inner surfaces 120,122 of terminating covers 34,36 are spaced from insulation piercing plates 94 to receive cable 24 therebetween. Cable 24 is moved, in an axial direction with respect to the conductors 22, into the space between fluted surfaces 120,122 and insulation displacement plates 94. Terminating covers 34,36 are then pressed, such as with a press or hand tool, toward each other to terminate conductors 22 in respective insulation displacing plates 94 in both rows of terminals 32 and to secure terminating covers 34,36 to insert 30 in a terminated position. During termination of cable 24 to connector 20, leg means 114,116 cooperate with apertures 110,112 to maintain proper orientation of terminating covers 34,36 relative to insulation displacement plates 94 to assure that terminating covers 34,36 move along a path orthogonal to surfaces 106,108. Also during termination, leg means 114,116 penetrate further into apertures 110,112 and the leading ends of leg means 114 on terminating cover 34 enter apertures 124 in terminating cover 36 while the leading ends of leg means 116 on terminating cover 36 simultaneously enter apertures 126 in terminating cover 34.

Apertures 126 are adjacent to leg means 114 on terminating cover 34 and receive leg means 116 in an interference fit. The interference fit is achieved in a terminated position by leg means 116 engaging a rib 128 which protrudes into respective apertures 128. The interference fit engages rib 128 against a surface 130 of leg means 116 that was not previously deformed. Apertures 124 are adjacent to leg means 116 on terminating cover 36 and secure leg means 114 in an interference fit. Interference fit is achieved in the terminated position by leg means 114 engaging a rib 132 (shown in phantom in FIG. 1) which protrudes into respective apertures 124. The interference fit engages rib 132 against a surface 134 that was not previously deformed.

The cross-section of leg means 116,118 complement each other to substantially fill apertures 110,112 and provide an interference fit with side walls 136. In a preferred embodiment, leg means 114,116 have a cross-section that is a chordal section of a circle, such as a semi-circle; apertures 110,112 are circular with two flat regions. In a preferred embodiment, terminating covers 34,36 are hermaphroditic.

Figure 4:
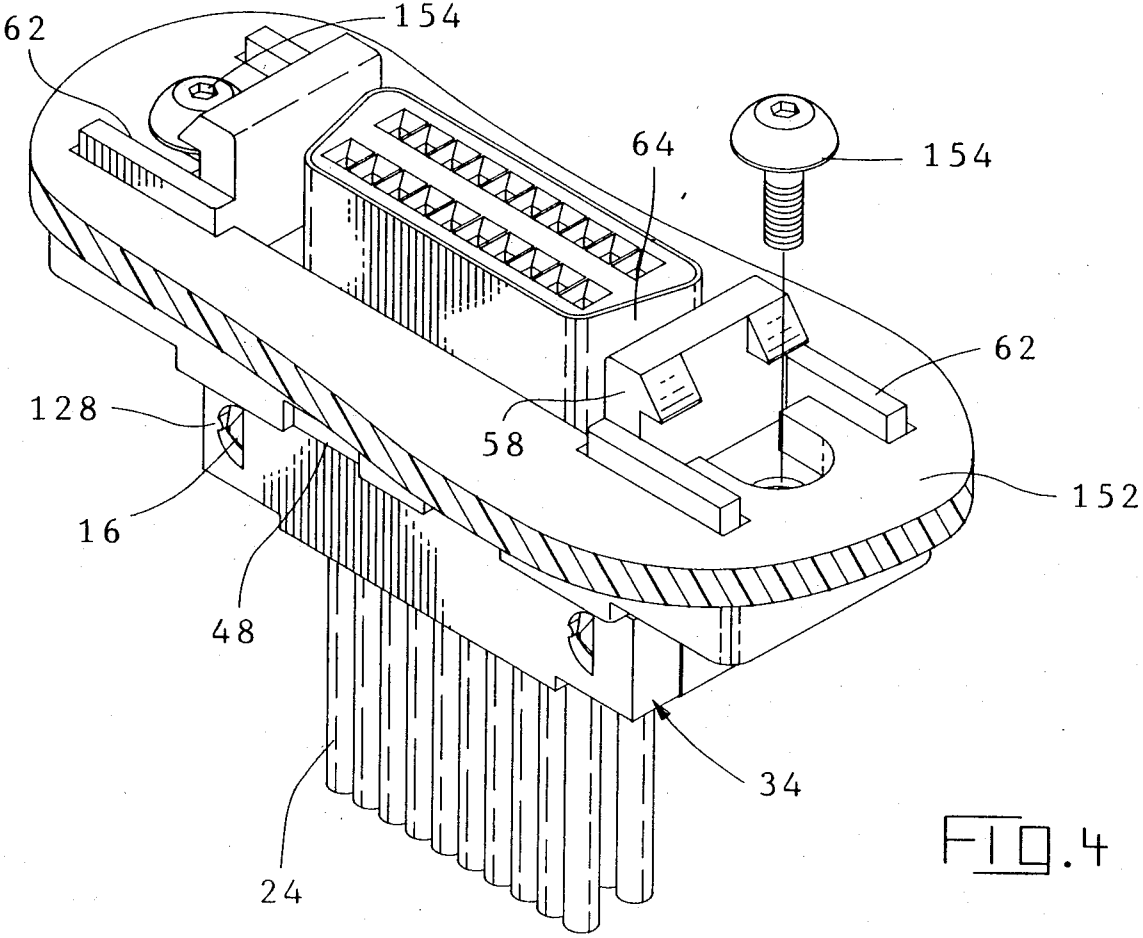
FIG. 4 is a perspective view of a connector mounted on a panel.

FIG. 4 is a perspective view of a connector 20 assembled, with a cable 24 terminated thereto. The connector is mounted in cutout 150 and secured to panel 152 by bolts 154, one of which is shown exploded from the connector and panel with the other bolt threaded into internally threaded bore 156 and flange 46.

Figure 5:
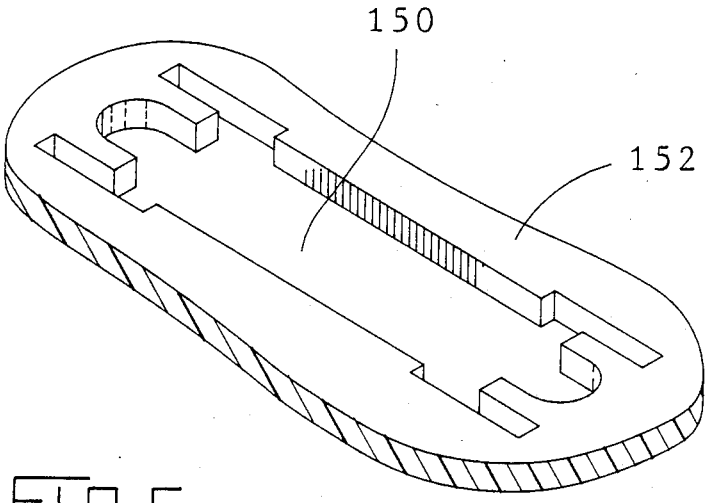
FIG. 5 is a panel cutout for a connector having rails.
Figure 6:
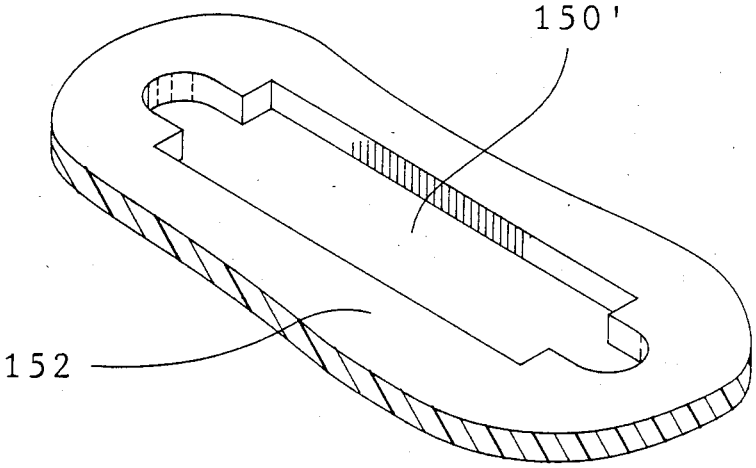
FIG. 6 is a panel cutout for a connector without rails.

FIG. 5 shows a cutout 150 in a panel 152. Cutout 150 is shaped to receive connector 20 of FIG. 1 which has rails 62. FIG. 6 shows a cutout 150' in a panel 152 shaped to receive a connector without rails.

The above described connector has terminals each having an insulation displacement plate 94 with an insulation piercing slot aligned with the mating portion 88 of the terminal 32, albeit oriented perpendicular to the axis of the mating portion of the terminal. Thus, the spacing of conductors in a cable 24 adapted to be terminated on shielded panel mount connector 20 is the same as the spacing of the mating portion of the terminals 32 in one of the rows of terminals.

An alternate embodiment shielded panel mount connector 20' is shown in FIGS. 7, 8, 9 and 10. In the cross-section shown in FIG. 7, shielded panel mount connector 20' is shown mounted in an aperture 150 and panel 152. Cable 24' passes straight through alternate embodiment connector 20'. The spacing of conductors in cable 24' adapted to be terminated on shielded panel mount connector 20' is one-half of the spacing of the mating portions of terminals 32' in one of the rows of terminals.

Figure 8:
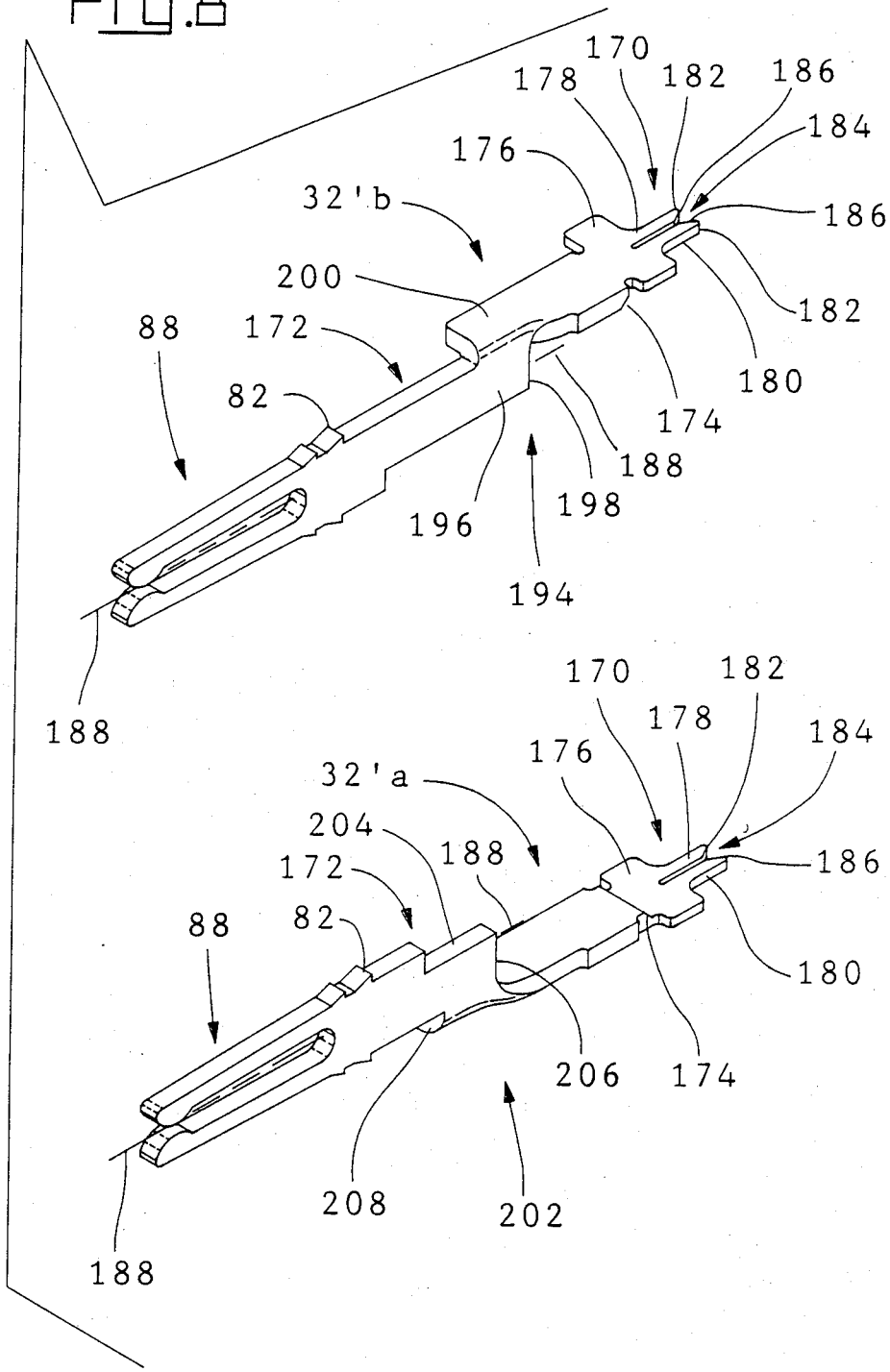
FIG. 8 is a perspective view of a pair of terminals for the alternate embodiment connector.

Insert 30' has a forward mating face 74, opposed conductor receiving face 76' and terminal receiving passages 78' extending therebetween, with terminals 32' secured therein. Contacts 32', as best seen in FIG. 8, are stamped and formed from strip stock, typically phosphor bronze. A portion of the width of the rolled stock is premilled to provide a thinner region along an edge of the strip stock. Each terminal 32' has a mating portion 88 at one end, an insulation displacement plate 170 at the other end, and an intermediate portion 172 therebetween. The mating portion of each terminal is stamped in the thicker portion of stock. The insulation displacement plate is stamped in the thinner region of the stock. Mating portion 88 extends forwardly of intermediate portion 172. Upon insertion of terminals 32' into passages 78' barbs 82 plow through passage walls 84' with plastic flowing around the barbs to provide an interference fit that secures contact 32' in passage 78'.

Insulation displacement plate 170 is fabricated in the thinner, premilled portion of the stock, with taper 174 defining the transition between the thicker and the thinner portions of the stock, to facilitate insulation displacement termination of conductors of ribbon cable 24' by reducing the force necessary to effect a termination. Insulation displacement plate 170 has a widened base region 176. A pair of insulation piercing tines 178,180 extend rearwardly from base region 176 to insulation piercing points 182 at the distal ends and define conductor receiving slot 184 therebetween. Tapered lead-in surfaces 186 angle toward conductor receiving slot 184. Slot 184 extends into widened base region 176 of plate 170 with the base region 176 being about half way along slot 184. Slot 184 is substantially parallel to the centerline 188 of the mating portion and laterally displaced therefrom, relative to insert 30', one-half of the centerline spacing of conductors in cable 24' adapted to be terminated to connector 20'.

Figure 7:
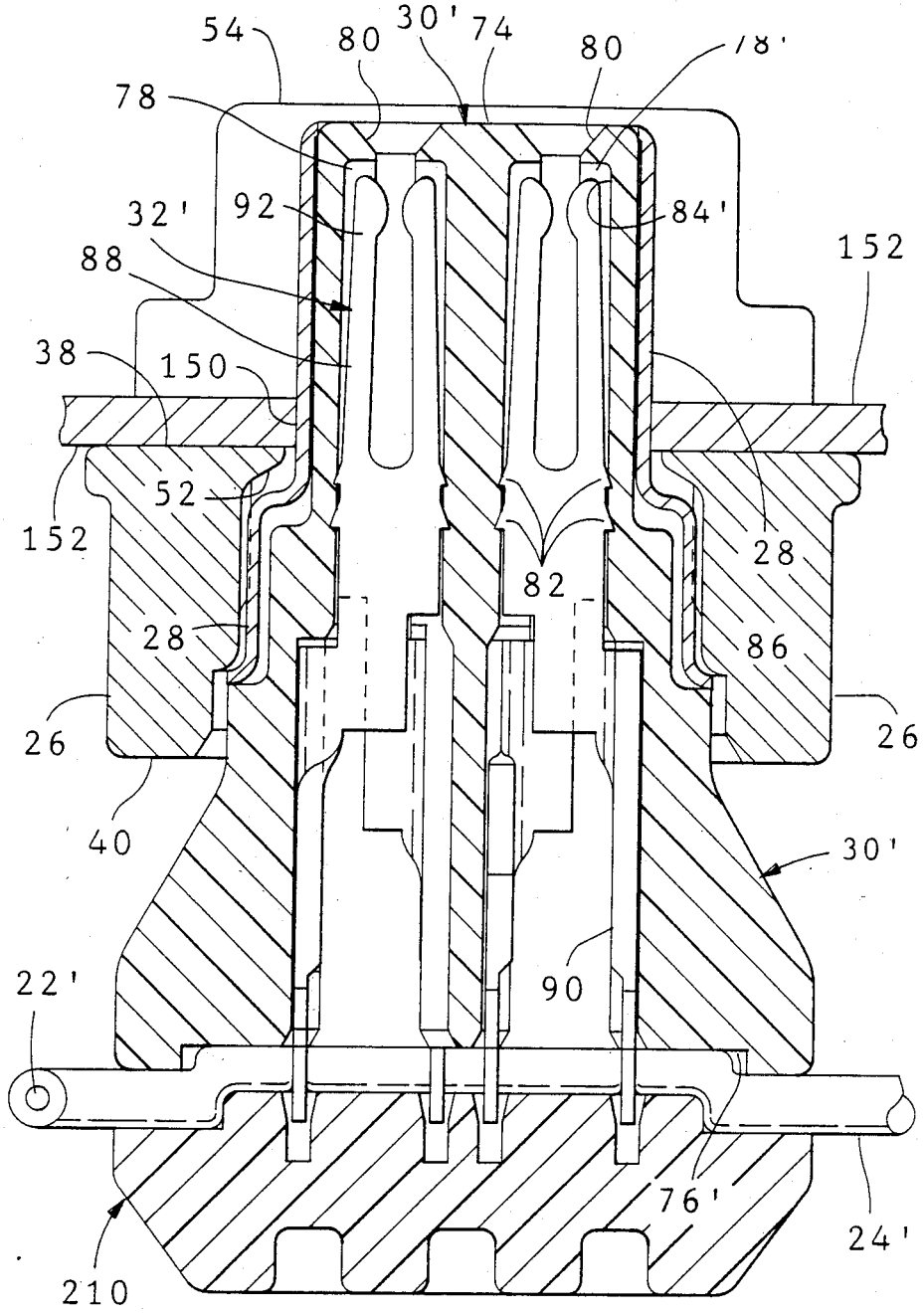
FIG. 7 is a cross-section of an alternate embodiment connector.
Figure 9:
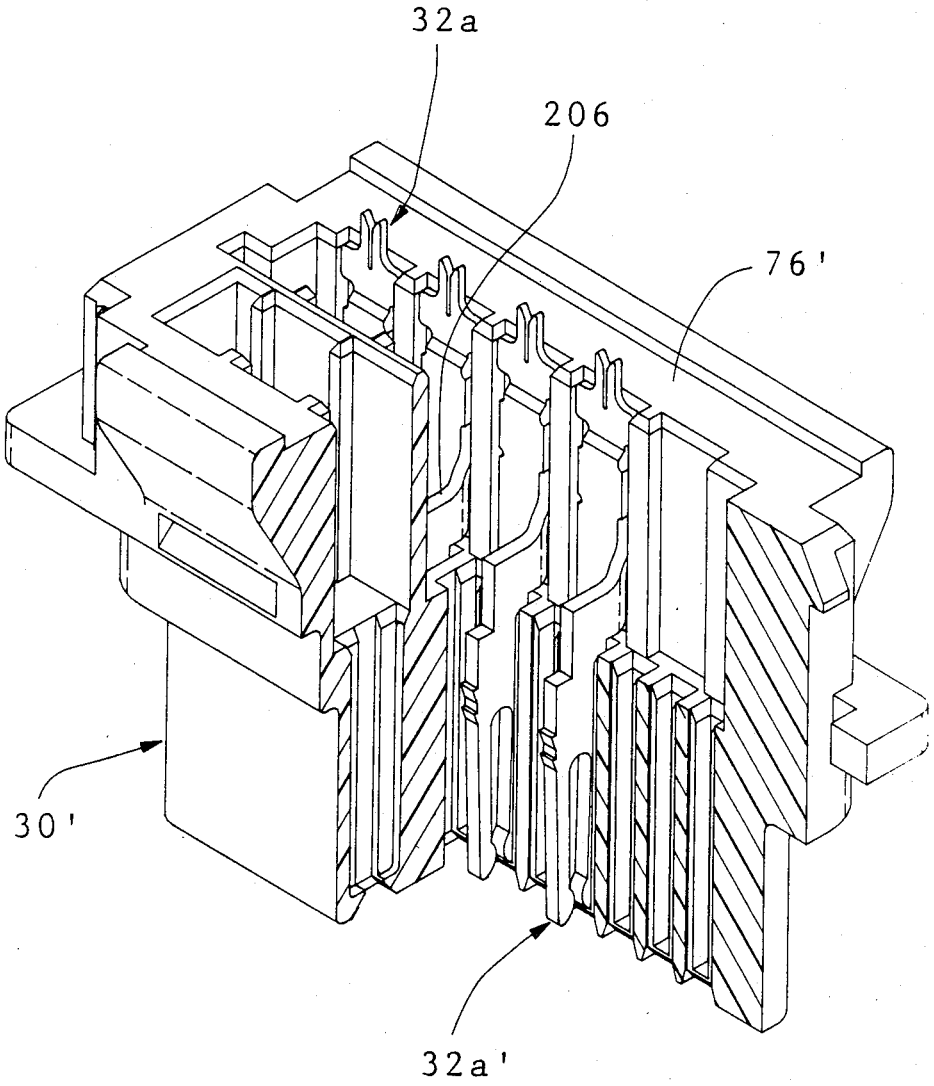
FIG. 9 is a perspective view, partially in section, of the alternate connector housing.
Figure 10:
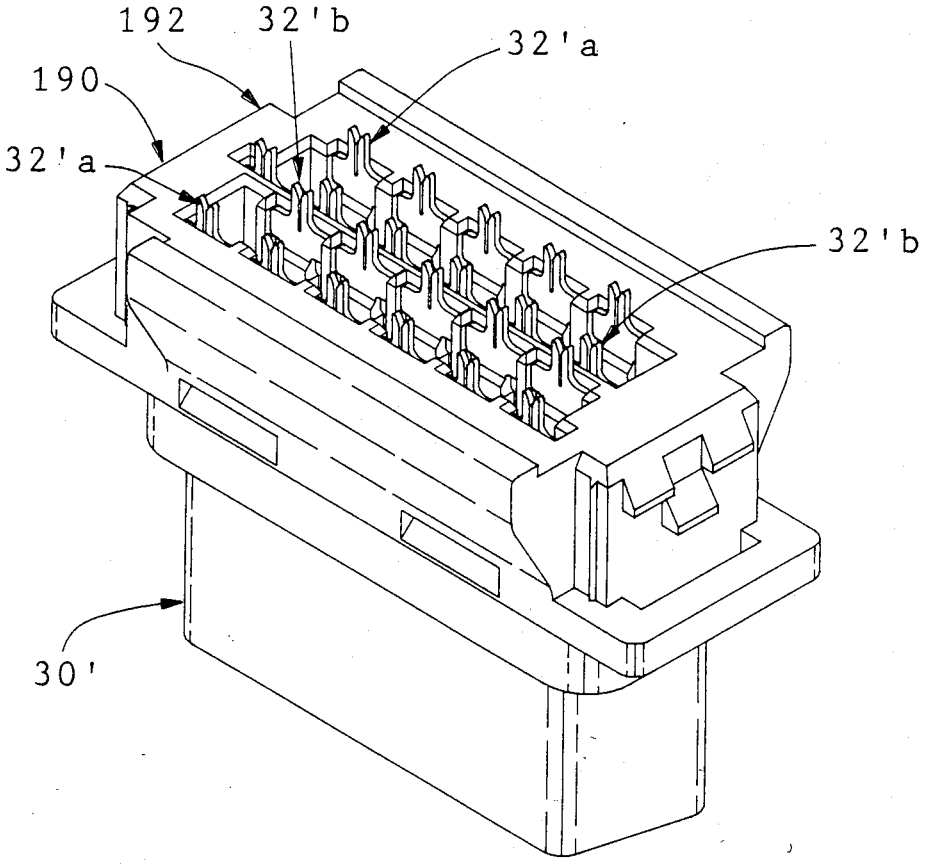
FIG. 10 is a perspective view of the alternate connector having the staggered insulation displacement plates.

As best seen in FIG. 8, there are two variations of terminals 32' with the general features described above. The two terminals are designated outside and inside. Terminal **32'*a* will be referred to as an outside terminal because the insulation displacement plates 170 of terminals 32'*a* form the two outer rows of insulation displacement plates, as best seen in FIG. 10. Terminals 32'*a* are also shown in FIGS. 7, 8 and 9. Terminals 32'*b* will be referred to as inside terminals because insulation displacement plates 170 of terminals 32*b* form the two inner rows of insulation displacement plates, as best seen in FIG. 10. Terminals 32'are also shown in FIGS. 7 and 8**.

The mating portion of an outer row of terminals **32'*a* and the mating portion of the adjacent inner row of contacts alternately interdigitate to form a first row 190 of receptacles. Similarly, the mating portion of the other outer row of contacts 32'*a* and the mating portion of the adjacent inner row of contacts 32'*b* also alternately interdigitate to form a second row 192** of receptacles.

Inside terminal **32'*b* has a lateral offset 194 within intermediate portion 172, a first portion 196 of which is rearward of mating portion 88 and defines rearward facing shoulder 198, and a second portion 200 contiguous therewith is forward of insulation displacement plate 170. Terminal 32'*b* is formed through lateral offset 194 such that mating portion 88 is in a plane substantially perpendicular to the plane of insulation displacement plate 170. First portion 196 substantially remains in the plane of mating portion 88; second portion 200 substantially remains in the plane of insulation displacement plate 170. Rearward facing shoulder 198 extends on both sides of centerline 188 and provides a surface on which an insertion force can be applied to insert terminal 32'*b* into passage 78'** without generating a moment to rotate the receptacle.

Outside terminal **32*a* has a lateral offset 202 within intermediate portion 172, a first portion 204 of which is rearward of mating portion 88 and defines rearward facing shoulder 206, and a second portion 208 contiguous therewith is forward of insulation displacement plate 170. Terminal 32'*a* is formed through lateral offset 202 such that mating portion 88 is in a plane substantially perpendicular to the plane of insulation displacement plate 170. First portion 204 substantially remains in the plane of mating portion 88; second portion 208 substantially remains in the plane of insulation displacement plate 170. Rearward facing shoulder 206 extends on both sides of centerline 188 and provides a surface on which an insertion force can be applied to insert terminal 32'*a* into passage 78'** without generating a moment to rotate the receptacle.

Shoulders 198 and 206 are displaced along centerline 188 of terminals **32'*b* and 32'*a* relative to each other such that one of the insertion shoulders is more forward than the other. As shown in FIG. 8, shoulder 206 is more forward on contact 32'*a* than shoulder 198 is on contact 32'*b*. Thus, a comb of outside contacts 32'*a* may be mass inserted with a tool pushing on shoulder 206 and subsequently a comb of inside contacts 32'*b* mass inserted with a tool pushing on shoulder 206 without the tool interfering with shoulder 116. In the formed terminals 32'*b* and 32'*a* shown in FIG. 8, the centerline 188 of receptacle 36 is laterally offset from the centerline of conductor receiving slot 184 by half of the centerline spacing of the conductors of cable 24' adapted to be terminated to connector 20'. FIG. 10 shows the staggered relationship of plates 170 and slots 184 resulting from the offset and orientation of the terminals in passage 78' of connector 20'**.

Connector 20' has a terminating cover 210 securable thereto for effecting mass termination of ribbon cable 24' or maintaining ribbon cable 24' in the terminated position. Any known terminating cover will suffice.

One such terminating cover is disclosed in copending application Ser. No. 07/304,046 filed Jan. 30, 1989, entitled "Strain Relief For Ribbon Cable Connector," the disclosure of which is hereby incorporated by reference.

We claim:

1. An electrical connector for terminating to conductors of a cable and for mounting through an aperture in a panel, said electrical connector comprising:

an electrically conductive die cast housing adapted to be mounted to the panel proximate the aperture therein, said housing having an aperture therein;

a drawn shell having an aperture, said drawn shell adapted to be received in the die cast housing and electrically commoned therewith, said drawn shell adapted to be received in the panel aperture;

an insulating insert adapted to be received and secured in the drawn shell aperture, said insert having terminals disposed in two rows therein, said terminals each having a mating portion and a cable conductor engaging portion, said cable conductor engaging portions adapted to be terminated to respective conductors of the cable; and a rear face on said insert, said terminals each defining an axis, each said cable conductor engaging portion extending beyond said rear face and formed to be an insulation displacing member having a slot therein, said slot extending beyond said die cast housing, whereby the shell provides shielding for the terminals with the die cast housing being electrically commoned with the shell and providing an electrical path to ground on the panel.

2. An electrical connector for terminating to conductors of a cable as recited in claim 1, wherein the insulation displacing member slots in one row of said terminals are opposed to the insulation displacing member slots in the other row of said terminals, further comprising a terminal support block extending from the rear face of said insert between the rows of terminals, the insulation displacing member slots in one row of terminals extending away from the terminal support block in a first direction, the insulation displacing member slots in the other row of terminals extending away from the terminal support block in a second direction, said second direction opposite to said first direction.

3. An electrical connector for terminating to conductors of a cable as recited in claim 2, further comprising a pair of terminating covers securable to said insert.

4. An electrical connector for terminating to conductors of a cable as recited in claim 1, wherein the mating portion of each terminal is perpendicular to the cable conductor engaging portion.

5. An electrical connector for terminating to conductors of a cable as recited in claim 4, wherein the mating portions lie in a plane and the cable conductor engaging portions lie in a plane, further comprising the terminals being formed such that the plane of the cable conductor engaging portions is perpendicular to the plane of the mating portions.

6. An electrical connector for terminating to conductors of a cable as recited in claim 1, wherein each terminal defines an axis, and each cable conductor engaging portion further comprises an insulation displacing plate having a slot therein, said slot oriented parallel to the terminal axis.

7. An electrical connector for terminating to conductors of a cable as recited in claim 6, wherein said slot is offset from the axis.

8. An electrical connector for terminating to conductors of a cable as recited in claim 6, further comprising a terminating cover securable to said insert.

* * * * *